United States Patent [19]

Matthews

[11] 4,401,336

[45] Aug. 30, 1983

[54] HOLLOW CORE HOLDER

[75] Inventor: Douglas A. Matthews, Circleville, Ohio

[73] Assignee: E. I. Du Pont de Nemours and Company, Wilmington, Del.

[21] Appl. No.: 235,037

[22] Filed: Feb. 17, 1981

[51] Int. Cl.[3] ..... B66C 1/54

[52] U.S. Cl. ..... 294/94; 294/67 A

[58] Field of Search ..... 294/93, 94, 67 A, 67 AA, 294/67 AB, 86 LS, 86.24, 86.25, 96, 103 CG; 414/910, 911; 269/48.1; 242/72 R; 279/2 R

[56] References Cited

U.S. PATENT DOCUMENTS 3,405,965 10/1968 Haas ..... 294/94

4,245,861 1/1981 Harry et al. ..... 294/94

*Primary Examiner*—James B. Marbert

[57] ABSTRACT

A hollow core holder comprising a hollow cylinder with a passive cam locking element eccentrically rotatably mounted inside the cylinder such that a portion of the edge of the cam protrudes through a slot in the wall of the cylinder in one rotation status and is wholly within the cylinder in another rotation status. As the core holder is inserted into a hollow core, the cam comes into contact with the core, holding the core to the core holder until a release mechanism rotates the cam into the cylinder, out of contact with the core.

4 Claims, 5 Drawing Figures

HOLLOW CORE HOLDER

BACKGROUND OF THE INVENTION

The field of the subject invention relates to devices for handling material on a hollow core or objects designed with a hollow core, without causing damage to the object or material wound on the core, or injury to the operator handling the core. In operation, the device of the subject invention, hereinafter the core holder, is inserted into one end of a hollow core and a passive cam locking element of the core holder holds the core firmly. A rod is operatively attached to the cam to allow release of the core. Core holders of the prior art comprise core inserts that are inflated inside the core and hence allow transportation of the core on the insert. These inflatable inserts do not have adequate locking means to hold the core on the core holder, and are uneconomical, time consuming and cumbersome where many core holders are necessary, for example, in the handling of many slit rolls on a film manufacturing line.

SUMMARY OF THE INVENTION

The subject invention comprises a hollow cylinder with at least one slot therein; at least one cam eccentrically rotatably mounted inside the cylinder to protrude from the cylinder through the slot in one rotation status and to be wholly within the cylinder in another rotation status; a rod for rotating the cam extending toward one end of the cylinder and attached to the cam; and biasing means to urge the rod to rotate the cam to protrude from the cylinder through the slot. The device of the subject invention may also include a disc having a diameter larger than the diameter of the cylinder mounted on the end of the cylinder through which the rod is extended, the rod consequently extending through the disc. A handle or other lifting means may also be attached to the disc to facilitate transportation of cores. The device of the subject invention is particularly useful for handling slit rolls in industrial film, however, it can be used to mechanically or manually handle any hollow core, i.e., to transport such a core or to insert or remove a core from an object.

DETAILED DESCRIPTION OF THE PREFERRED EMBODIMENT

Figure 1:
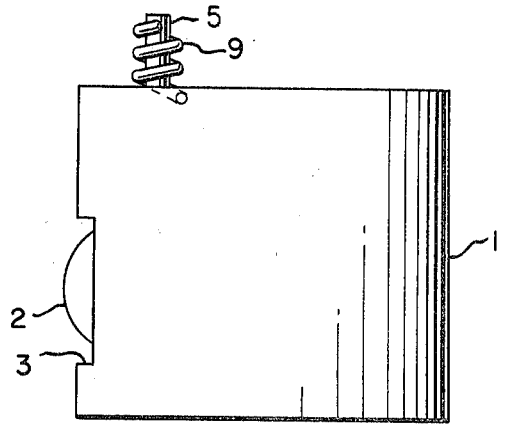
FIG. 1 is a full perspective view of a device of the subject invention.

FIG. 1 is a full side view of the device of the subject invention depicting cam 2 protruding from cylinder 1 through slot 3. Rod 5 is also shown extending out one end of cylinder 1 with biasing means 9 attached to rod 5 and cylinder 1.

Figure 2:
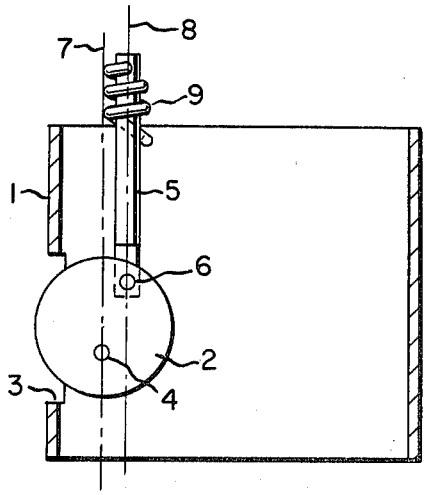
FIG. 2 is a partial cutaway view of a device of the subject invention.

FIG. 2, cylinder 1 has cam 2 mounted therein at cam mounting point 4 such that the edge of cam 2 protrudes from slot 3 in the surface of cylinder 1. The edge of the cam can be smooth or rough (teethed, knurled, spiked, etc.). One end of rod 5 is extended toward one end of the cylinder, the other end of rod 5 is attached to cam 2 at point 6 such that, when the protruding edge of cam 2 is flush with the outside surface of cylinder 1, the longitudinal axis 8 of rod 5 is further away from slot 3 than is line 7 drawn through cam mounting point 4 parallel with the longitudinal axis 8. In this mounting position, biasing means 9 is attached to rod 5 and cylinder 1 to urge rod 5 to pull cam 2 and, thereby, to urge cam 2 to protrude from slot 3. Means other than rod 5 can be used to rotate cam 2 to protrude through slot 3, for example, electromagnetic forces. In this rotation status, the device of FIG. 2 can be inserted into a hollow core such that cam 2 comes in contact with the inside surface of the hollow core thus locking the core onto the device of FIG. 2. Because the cam is eccentrically mounted inside the cylinder, the greater the weight of the core, or the greater a force urging the core off of the cylinder, the more tightly the cam is urged against the inside surface of the core. The core is released by urging rod 5 in the direction of the cam, thereby, rotating cam 2 to a rotation status wholly within cylinder 1 out of contact with the hollow core.

Figure 3:
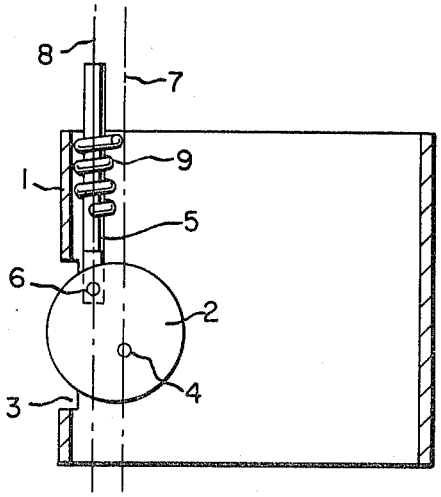
FIG. 3 is a partial cutaway view of a device of the subject invention with the cam mounted so as to release in a rotation status opposite the release rotation status of FIG. 2.

In FIG. 3 the release mechanism of FIG. 2 is reversed such that rod 5, extending toward one end of cylinder 1, is attached to cam 2 at point 6 such that, when the protruding edge of cam 2 is flush with the outside surface of cylinder 1, the longitudinal axis 8 of rod 5 is closer to slot 3 than is line 7 drawn through point 4 parallel with longitudinal axis 8. Biasing means 9 is attached to rod 5 and to cylinder 1 to urge rod 5 to push cam 2 and, thereby, to urge cam 2 to protrude from slot 3. This rotation status of cam 2 allows the cam to hold a hollow core on the device of the subject invention after the core is inserted into the device. The release mechanism then operates by pulling rod 5 away from the cam, thereby, rotating cam 2 to a rotation status wholly within cylinder 1 out of contact with the hollow core.

Figure 4:
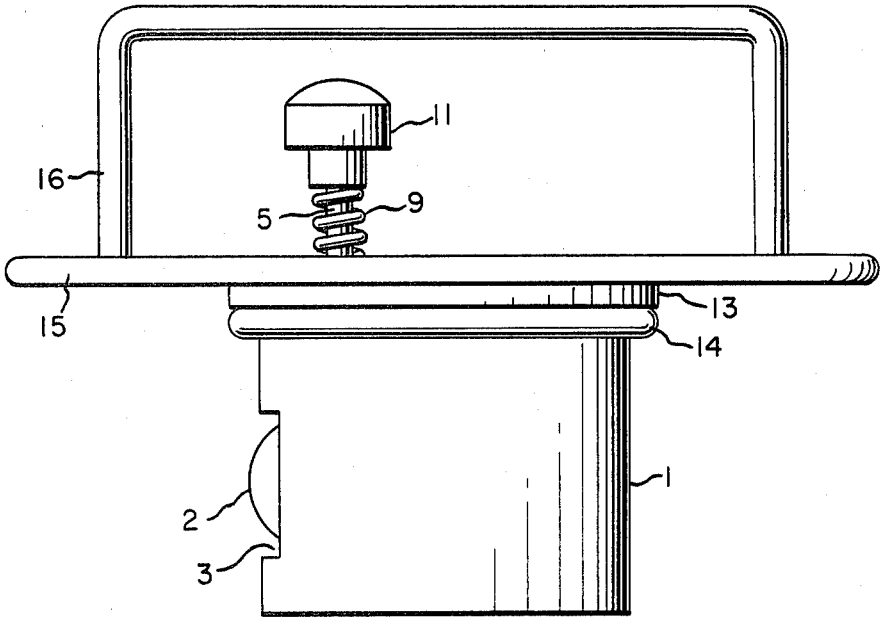
FIG. 4 is a side view of a preferred embodiment of the subject invention.

FIG. 4 shows a side view of a preferred embodiment of the subject invention. Disc 15, having a diameter larger than the diameter of cylinder 1 is mounted flush on the end of the cylinder toward which rod 5 is extended, the rod consequently extending through the disc. Button 11 or a similar attachment for releasing the cam is mounted to the end of rod 5. Biasing means 9 urges rod 5 away from cam 2, thus returning cam 2 to its protruded position through slot 3. Handle 16 is mounted on disc 15 so that the device of the subject invention can be transported with a hollow core attached and, subsequently, the core can be released at some point of destination. Attachments other than handle 16 can be used if handling of a core is to be done mechanically. Collar 13 and o-ring 14 can be used to maintain a spacing between any core on the device and disc 15.

Figure 5:
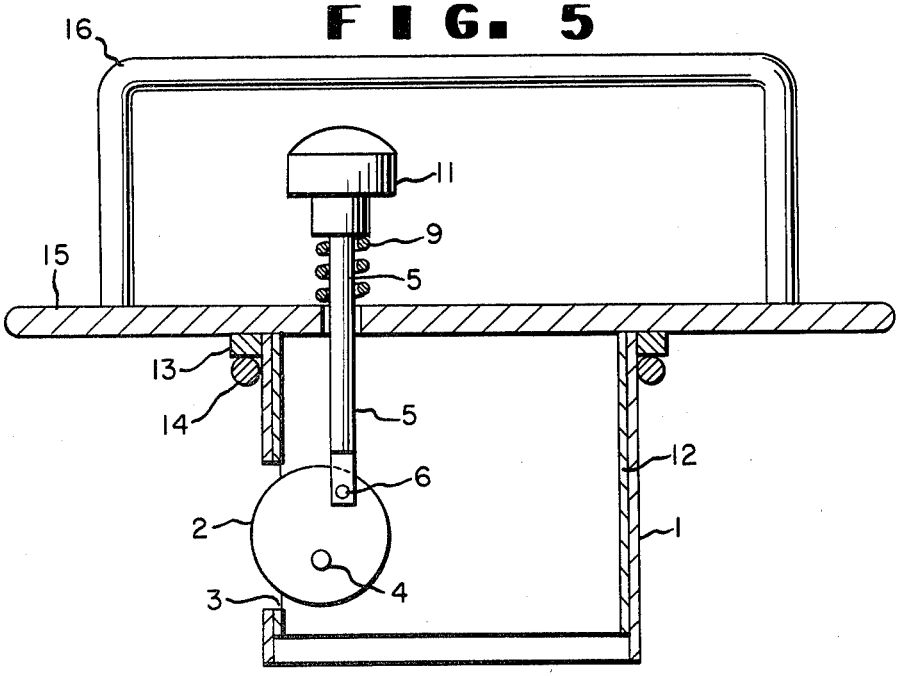
FIG. 5 is a partial cutaway view of a preferred embodiment of the subject invention.

In FIG. 5 cam housing 12 is used to mount cam 2 inside cylinder 1 at mounting point 4. Cam 2 may be mounted inside cylinder 1 in any alternate manner without varying from the scope of the subject invention, including mounting cam 2 directly to cylinder 1, as seen in FIG. 3. Rod 5 is attached to the cam at point 6 such that biasing means 9 urges the rod to rotate the cam and, thereby, urges the cam to protrude from cylinder 1 through slot 3. Again, collar 13 and o-ring 14 can be mounted around cylinder 1 to protect material wound on a hollow core from being damaged by contact with disc 15. Handle 16 and button 11 facilitate manual handling of hollow cores.

It may be desirable to use the device of the subject invention in both ends of a hollow core, or use the device of the subject invention in one end of a hollow core and use a simple core insert without a cam locking element, on the opposite end of the hollow core. In either case, the use of the device of the subject invention both protects materials on the hollow core and facilitates the handling of the core.

EXAMPLE

This example is to illustrate how the device of the subject invention protects a winding of material around a hollow core during transportation of the core in a plant manufacturing situation.

Over a number of years, data relating to edge damage during the handling of polyethylene terephthalate slit rolls without the benefit of any core handling device showed that edge damage rejects ranged from 8–20% of the number of rolls handled. For comparison purposes, two pallets of slit rolls, 116 rolls per pallet, were loaded and unloaded using the device of the subject invention. In addition to the greater ease of handling the slit rolls using the device of the subject invention, edge damage rejects were reduced to 2–4%.

I claim:

1. A device for insertion into and handling of a hollow core comprising:

(i) a hollow cylinder with at least one slot therein;

(ii) at least one cam eccentrically rotatably mounted inside said cylinder to protrude from the cylinder through the slot in one rotation status and to be wholly within the cylinder in another rotation status;

(iii) a rod for rotating the cam extending out of one end of the cylinder and attached to the cam such that, when the protruding edge of the cam is flush with the outside surface of the cylinder, the rod is attached to the cam such that the longitudinal axis of the rod is further away from the slot than is a line drawn through the point at which the cam is mounted parallel with the axis of the rod;

(iv) biasing means to urge the rod to pull the cam and, thereby, to urge the cam to protrude from the cylinder through the slot.

2. A device for insertion into and handling of a hollow core comprising:

(i) a hollow cylinder with at least one slot therein;

(ii) at least one cam eccentrically rotatably mounted inside said cylinder to protrude from the cylinder through the slot in one rotation status and to be wholly within the cylinder in another rotation status;

(iii) a rod for rotating the cam extending out of one end of the cylinder and attached to the cam such that, when the protruding edge of the cam is flush with the outside surface of the cylinder, the rod is attached to the cam such that the longitudinal axis of the rod is closer to the slot than is a line drawn through the point at which the cam is mounted parallel with the axis of the rod;

(iv) biasing means to urge the rod to push the cam and, thereby, to urge the cam to protrude from the cylinder through the slot.

3. The device of claims 1 or 2 further comprising a disc having a diameter larger than the diameter of the cylinder, said disc mounted flush on the end of the cylinder through which the rod is extended, said rod extending through said disc.

4. The device of claim 3 further comprising a handle mounted on said disc.

* * * * *